United States Patent [19]

Yamamoto et al.

[11] Patent Number: 4,861,017

[45] Date of Patent: Aug. 29, 1989

[54] PAPER-FEEDING DEVICE

[75] Inventors: Kiyonori Yamamoto; Osamu Sota, both of Osaka; Masahiko Sakae, Nara; Yoshinori Makiura, Osaka; Masahiro Murakami, Osaka; Toshiyuki Mitsuya, Osaka, all of Japan

[73] Assignee: Mita Industrial Co., Ltd., Osaka, Japan

[21] Appl. No.: 111,478

[22] Filed: Oct. 22, 1987

[30] Foreign Application Priority Data

Oct. 23, 1986 [JP] Japan ..... 61-252180

[51] Int. Cl.[4] ..... B65H 7/02

[52] U.S. Cl. ..... 271/258; 271/145; 271/162

[58] Field of Search ..... 109/38, 39; 271/145, 271/162, 164, 167, 127, 126, 258, 153, 155, 118; 221/263, 154

[56] References Cited

U.S. PATENT DOCUMENTS

| | | | |
|---|---|---|---|
| 3,689,064 | 9/1972 | Kuksa | 271/164 |
| 4,402,498 | 9/1983 | Suzuki . | |
| 4,466,604 | 8/1984 | Kishimoto et al. | 271/155 |
| 4,488,718 | 12/1984 | Tamura | 271/162 |
| 4,551,813 | 11/1985 | Sanbayashi et al. | 271/258 |

FOREIGN PATENT DOCUMENTS

| | | | |
|---|---|---|---|
| 2229 | 6/1979 | European Pat. Off. . | |
| 52841 | 4/1980 | Japan | 271/258 |
| 127530 | 6/1986 | Japan | 271/145 |
| 162432 | 7/1986 | Japan | 271/145 |

OTHER PUBLICATIONS

Patent Abstracts of Japan, vol. 3, No. 151 (M-84), 12-1-2-79, p. 35 M 84; & JP-A-54 126 369 (Ricoh) 10-1-79.

Patent Abstracts of Japan, vol. 5, No. 56 (P-57) [728], 4-17-81; & JP-A-56 9758 (Canon) 31-1-81.

Patent Abstracts of Japan, vol. 5, No. 110 (P-71) [782], 7-17-81; & JP-A-56 51759 (Canon) 9-5-81.

Patent Abstracts of Japan, vol. 9, No. 190 (P-378) [1913], 8-7-85; & JP-A-60 57865 (Ricoh)3-4-85.

*Primary Examiner*—H. Grant Skaggs

*Attorney, Agent, or Firm*—Beveridge, DeGrandi & Weilacher

[57] ABSTRACT

A paper-feeding device which includes a paper-feeding cassette removably located into an image processing apparatus, a locking mechanism for inhibiting extraction of the paper-feeding cassette by engaging with the cassette or a cassette mount, and a locking control device for activating operation of the locking mechanism while a paper-feeding operation is underway. Since the locking control device remains activated while the paper-feeding operation is underway, the operator cannot extract the paper-feeding cassette from the image processing apparatus during a paper-feeding operation.

6 Claims, 14 Drawing Sheets

PAPER-FEEDING DEVICE

BACKGROUND OF THE INVENTION

The present invention relates to a paper-feeding device, and more particularly, to a paper-feeding device which is provided with a constitution allowing a paper-feeding cassette to be removably loaded into an image processing apparatus and securely locking the paper-feeding cassette so that the operator can be prevented from carelessly extracting it from the image processing apparatus during the paper-feeding operation.

Conventionally, there are a variety of image processing apparatuses like electrophotographic copying apparatuses or laser printers for example. Any conventional image processing apparatus is provided with a mechanism allowing the operator to easily change the paper size by merely replacing the paper-feeding cassette loaded in the paper-feeding device if copying papers having a different size should be used. However, since these conventional paper-feeding devices are not provided with a mechanism for inhibiting the extraction of the paper-feeding cassette, if the operator carelessly extracts the paper-feeding cassette from the paper-feeding device immediately after activating the copy-start switch, then, a controller inside of the image processing apparatus cancels execution of the entire copying operation. As a result, paper-delivery is stopped on the way, thus eventually incurring a jamming symptom and wasting the delivered copying paper as well. In particular, if the image processing apparatus is provided with a specific paper-feeding device allowing the paper-feeding cassette to be extracted in the direction 90 degrees apart from the paper-feeding direction, since the paper-feeding device can be normally installed to the lower front portion of the image processing apparatus, the operator can easily replace the paper-feeding cassette or replenish copying paper as required in front of the image processing apparatus. However, since any of paper-feeding devices feeds copying papers from the paper-feeding cassette in the direction 90 degrees apart from the direction of extracting the cassette throughout the image processing operation, if the operator attempts to extract the cassette while the paper-feeding operation is underway, the copying paper caught between the cassette and the image processing apparatus prevents the operator from extracting the cassette from the image processing apparatus, thus eventually making it too difficult for the operator to quickly dispose of the jammed paper. Likewise, even if the operator could narrowly extract the cassette from the image processing apparatus, the jammed paper will be torn into pieces which then stay in the paper-feeding path. As a result, this incurs much inconvenience to the operator to thoroughly remove the torn-up pieces from the paper-feeding path, thus eventually resulting in the waste of time spent for unwanted labor before the operator can resume normal copying operation.

SUMMARY OF THE INVENTION

The primary object of the present invention is to provide a novel paper-feeding device which securely saves copying papers and prevents these papers from being jammed throughout the image formation processes by effectively inhibiting the paper-feeding cassette from being extracted from the image processing apparatus even when the operator carelessly attempts to extract the cassette while the paper-feeding operation is still underway after activating the copy-start switch of the image processing apparatus.

The above object can securely be achieved by providing the paper-feeding device according to the invention, in which the paper-feeding device is substantially comprised of a paper-feeding cassette which can be inserted into and smoothly drawn out of the image processing apparatus as required, locking means inhibiting extraction of the paper-feeding cassette by engaging itself with either the paper-feeding cassette or the paper-feeding cassette mount, and locking control means activating the operation of the locking means throughout the paper-feeding operation.

The paper-feeding device incorporating the constitution mentioned above securely activates the operation of the locking control means throughout the paper-feeding operation so that the locking means can simultaneously be activated, thus securely preventing the operator from carelessly extracting the paper-feeding cassette while the paper-feeding operation is still underway.

The advantages of the paper-feeding device according to the invention will become more apparent from the following description in reference to the accompanying drawings.

DESCRIPTION OF THE PREFERRED EMBODIMENTS

Summary of the Electrophotographic Copying Apparatus

Figure 1:
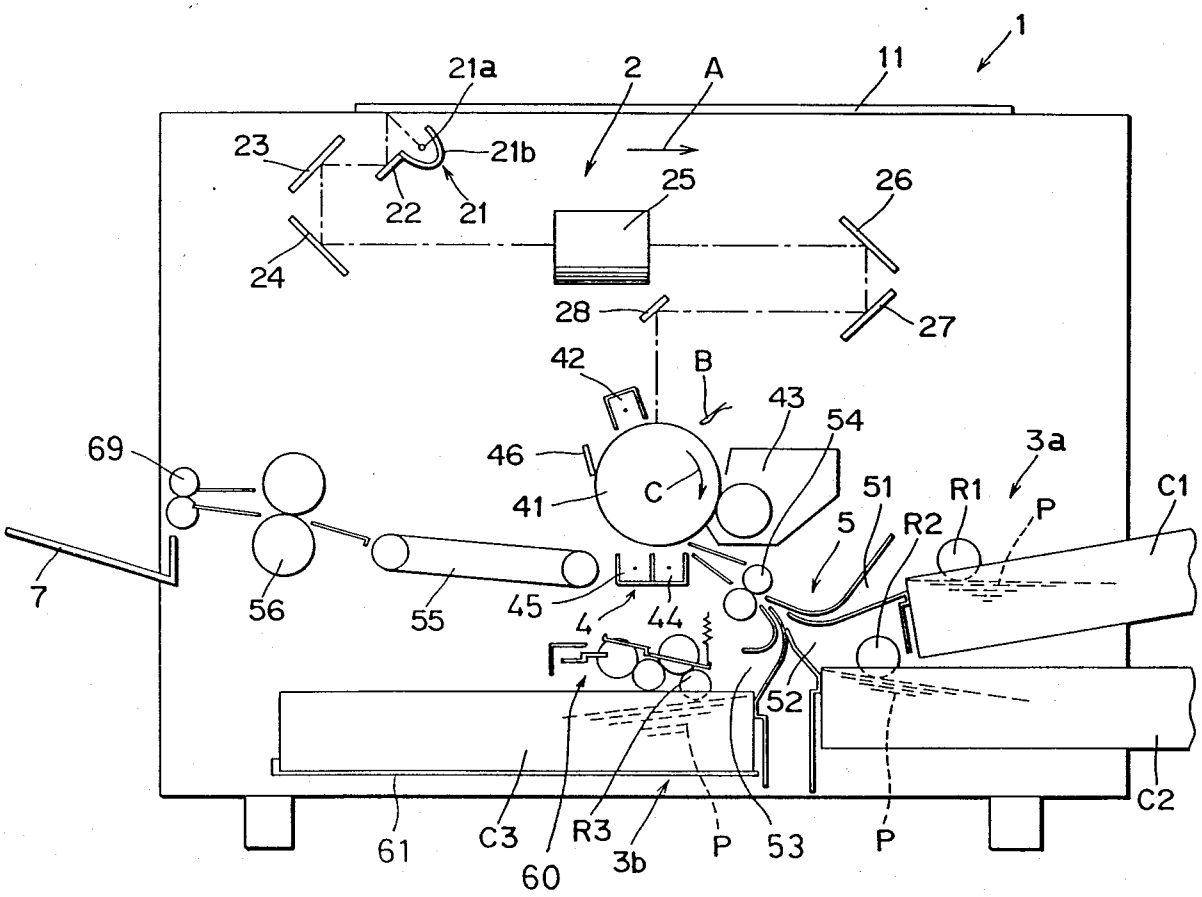
FIG. 1 is a simplified block diagram denoting the internal constitution of the electrophotographic copying apparatus incorporating a preferred embodiment of the paper-feeding device according to the present invention.

FIG. 1 is a simplified block diagram of an electrophotographic copying apparatus incorporating a preferred embodiment of the paper-feeding device according to the present invention. An optical system 2 for scanning and applying light-exposure to the original document is disposed in the upper predetermined position inside of the electrophotographic copying apparatus 1. A multiple-cassette loading paper-feeding device 3*a* is disposed in the right lateral surface of the copying apparatus 1 to allow the paper-feeding cassette C1 and C2 to securely be loaded into and unloaded from the paper-feeding device 3*a* as required. Another pull-out type paper-feeding device 3*b* is disposed in the bottom surface of the copying apparatus 1 to allow the paper-feeding cassette C3 to be loaded into and unloaded from the front surface of the copying apparatus 1. A copying section 4 for forming an image on the copying paper P and a paper-conveying section 5 for conveying the copying paper P are respectively provided between the optical system 2 and the paper-feeding devices 3*a* and 3*b*. A tray 7 receives the copied paper P discharged from the copying apparatus 1.

Figure 2:
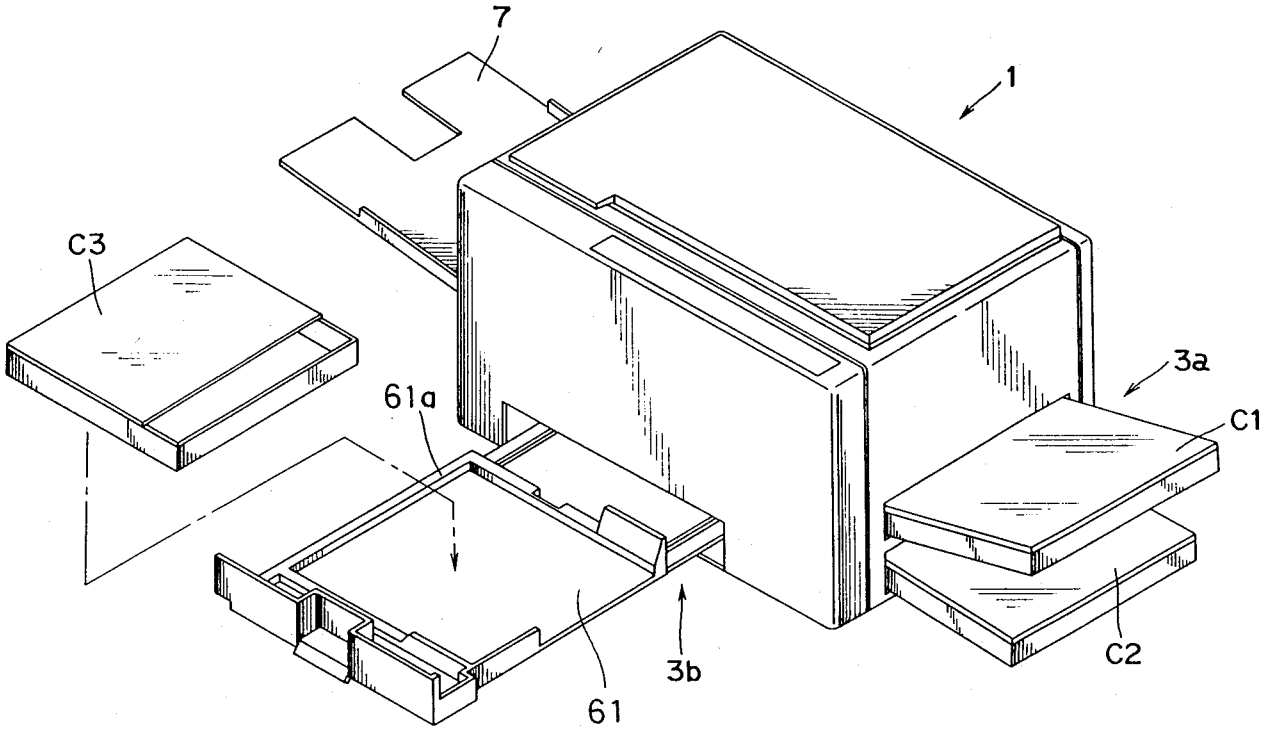
FIG. 2 is a perspective view of the electrophotographic copying apparatus shown in FIG. 1.

The optical system 2 incorporates a light source 21 which is comprised of an illuminator 21*a* and a main reflector 21*b*, plane reflection mirrors 22 through 24, a lens 25, and plane reflection mirrors 26 through 28, respectively. The optical system 2 scans and allows the original document on a contact glass 11 to be exposed to light by moving the positions of the light source 21 and the plane reflection mirrors 22 through 24 in the direction of arrow A along the guide shaft (not shown). The paper-feeding cassettes C1 through C3 are respectively of the conventional type, each storing a number of copying papers P having sizes different from each other, while each of these cassettes C1 through C3 can optionally be loaded into any of the paper-feeding devices 3*a* and 3*b*. The paper-feeding cassette mount 61 mounting the desired paper-feeding cassette C3 chosen from those cassettes mentioned above is disposed in the paper-feeding device 3*b* to allow the cassette mount 61 to freely be inserted into and drawn out of it. A frame 61*a* shown in FIG. 2 allows the paper-feeding cassette C3 to be loaded into an adequate position of the paper-feeding cassette mount 61. A projection 94 is provided at the tip portion of the cassette-insertion side of the cassette mount 61 as described later on in reference to FIG. 9. A cassette-mount detecting switch 92 detects whether the paper-feeding cassette mount 61 has fully been inserted or not, by identifying that the projection 94 is in contract with the detecting switch 92.

The copying section 4 is comprised of a corona discharger 42, blank lamp B, developing device 43, transferring corona discharger 44, separation corona discharger 45, and cleaner 46, which are respectively disposed in the order mentioned above around a periphery of a photoreceptive drum 41 which rotates itself in the direction C shown in FIG. 1. The blank lamp B discharges electrostatic charge which has been uniformly charged by the corona discharger 42 from the out skirt of the surface of the photoreceptive drum 41. Next, an electrostatic latent image is generated by causing an image of the original document to be formed on the surface of the photoreceptive drum 41. Then, the electrostatic latent image is developed into a toner image by the developing device 43. The developed toner image is then transferred onto the copying paper P by means of the transferring corona discharger 44 before eventually allowing the cleaner 46 to fully collect the residual toner.

The copying-paper conveying section 5 is comprised of paper-feeding rollers R1 and R2, paper-feeding paths 51 through 53, registration roller 54, conveyor belt 55, toner-fixation roller 56, and copied-paper discharging roller 69, respectively. Each piece of the copying papers P is drawn out of the paper-feeding cassette C1 or C2 by selectively driving the paper-feeding roller R1 or R2, and then, the copying paper P is delivered to the copying section 4, where the toner image is transferred onto the copying paper P. After heating the toner image to fix it onto the copying paper P by applying the toner-fixation roller 56, the toner-fixed paper P is eventually delivered to the tray 7 through the paper-discharging roller 69.

Paper-Feeding Device

Figure 3:
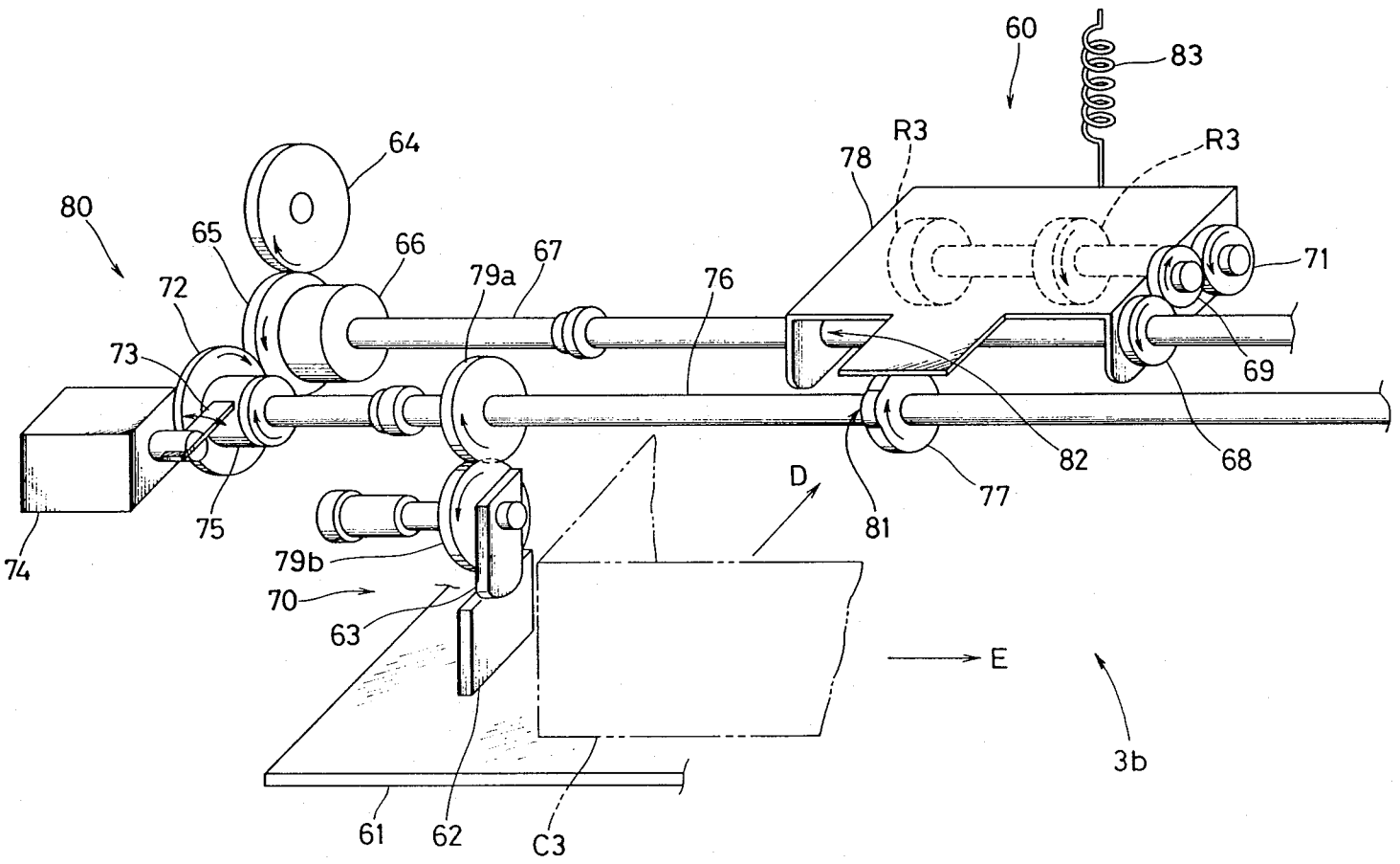
FIG. 3 is a perspective view of the essential constituents of the preferred embodiment of the paper-feeding device according to the invention.

FIG. 3 denotes the partial constitution of the components of the paper-feeding device 3*b* according to the present invention. The paper-feeding device 3*b* is comprised of the following; a paper-feeding cassette mount 61 mounting the paper-feeding cassette C3, a paper-feeding feeding section 60 allowing the paper-feeding cassette C3 to deliver the copying paper P in the direction of arrow D before delivering the copying paper P to the registration roller 54, a cassette-mount locking device 70 which prevents the paper-feeding cassette mount 61 from being extracted from the copying apparatus 1 by the operator, a locking-control device 80 which activates the operations of the paper-feeding section 60 and the locking device 70 at a predetermined timing.

The paper-feeding cassette mount 61 is loaded into and unloaded from the copying apparatus 1 in the direction 90 degrees apart from the direction of arrow D conveying the copying paper P, i.e., in the direction of arrow E shown in FIG. 3. The paper-feeding cassette C3 is loaded into and unloaded from the copying apparatus 1 simultaneously with the loading or unloading action of the paper-feeding cassette mount 61 into and from the copying apparatus 1. An engaging plate 62 is secured to the paper-feeding cassette mount 61. As soon as the paper-feeding roller R3 starts to rotate to feed the copying paper P, a stopper 63 also starts to operate itself by mechanical connection with the paper-feeding roller R3, and the stopper 63 is engaged with the engaging plate 62 so as to inhibit the paper-feeding cassette mount 61 from carelessly being drawn out of the copying apparatus 1. More particularly, the paper-feeding section 60 is comprised of an oscillating plate 78 which is supported by a shaft 67 inserted through a hole 82 formed on the oscillating plate 78, a paper-feeding roller R3 which comes into contact with the upper surface of the copying paper P before starting to feed it, and gears 68, 69, and 71, which respectively transmit the rotating force of the shaft 67 to the paper-feeding roller R3. A bottom end of a return spring 83 is engaged with an end of the oscillating plate 78 so that it exerts its restoring force on the oscillating plate 78 in one direction. The shaft 67 is connected to a gear 65 via a paper-feeding clutch 66. Gear 65 is engaged with a gear 64 which is driven by a motor (not shown) which constantly rotates itself throughout the copying operation. A gear 68 is connected to the other end of the shaft 67, while the gear 68 drives a gear 71 which rotates the paper-feeding roller R3 via a gear 69.

A gear 72 engaged with the gear 65 is coupled to a shaft 76 via a spring clutch 75. And a gear 79*a* and a cam 77 are coupled to the shaft 76, while the circumferential surface of the cam 77 is provided with a projection 81 in order that the projection 81 raises the position of the edge portion of the oscillating plate 78, when the projection 81 comes in contact with the bottom surface of the oscillating plate 78 as the cam 77 rotates. As soon as the edge portion of the oscillating plate 78 is raised, the paper-feeding roller R3 comes into contact with the copying paper P inside of the paper-feeding cassette C3. The gear 79*a* causes the stopper 63 to move via a gear 79*b*.

A solenoid 74 adjoining the spring clutch 75 is provided with a lever 73 which is to be engaged with either of claws 75*a* or 75*b* (shown in FIG. 4) which are provided opposite from each other on the external circumferential surface of the spring clutch 75. These claws 75*a* and 75*b* turn the spring clutch 75 ON (to allow the gear 72 to transmit the rotating force to the shaft 76) or OFF (to inhibit the gear 72 from transmitting the rotating force to the shaft 76). The spring clutch 75 rotates itself when the lever 73 is disengaged from either claw 74*a* or 75*b* so that the rotating force of the gear 72 can be transmitted to the shaft 76. Conversely, when the lever 73 is engaged with either claw 75*a* or 75*b*, the spring clutch 75 does not rotate itself, thus inhibiting the rotating force of the gear 72 from being transmitted to the shaft 76.

Next, the functional operation of the above mechanism is described below. First, the operator depresses the copy-start switch to activate the photographic copying operation. Simultaneously, the motor (not shown) connected to the driving gear 64 starts to rotate and also rotate gears 65 and 72 via the driving gear 64. At the same time, a controller unit of the copying apparatus 1 outputs a paper-feeding timing signal to the paper-feeding clutch 66 and the solenoid 74. This activates the paper-feeding clutch 66, and the rotating gear starts to cause the paper-feeding roller R3 to rotate via the paper-feeding clutch 66, shaft 67, and gears 68, 69, and 71, respectively. Simultaneously, the solenoid is also activated to cause the lever 73 which has been engaged with the claw 75*b* of the spring clutch 75 to oscillate (move) in the direction of the arrows shown in FIG. 3 so that it can perform a reciprocating movement before stopping at the original position.

Figure 4:
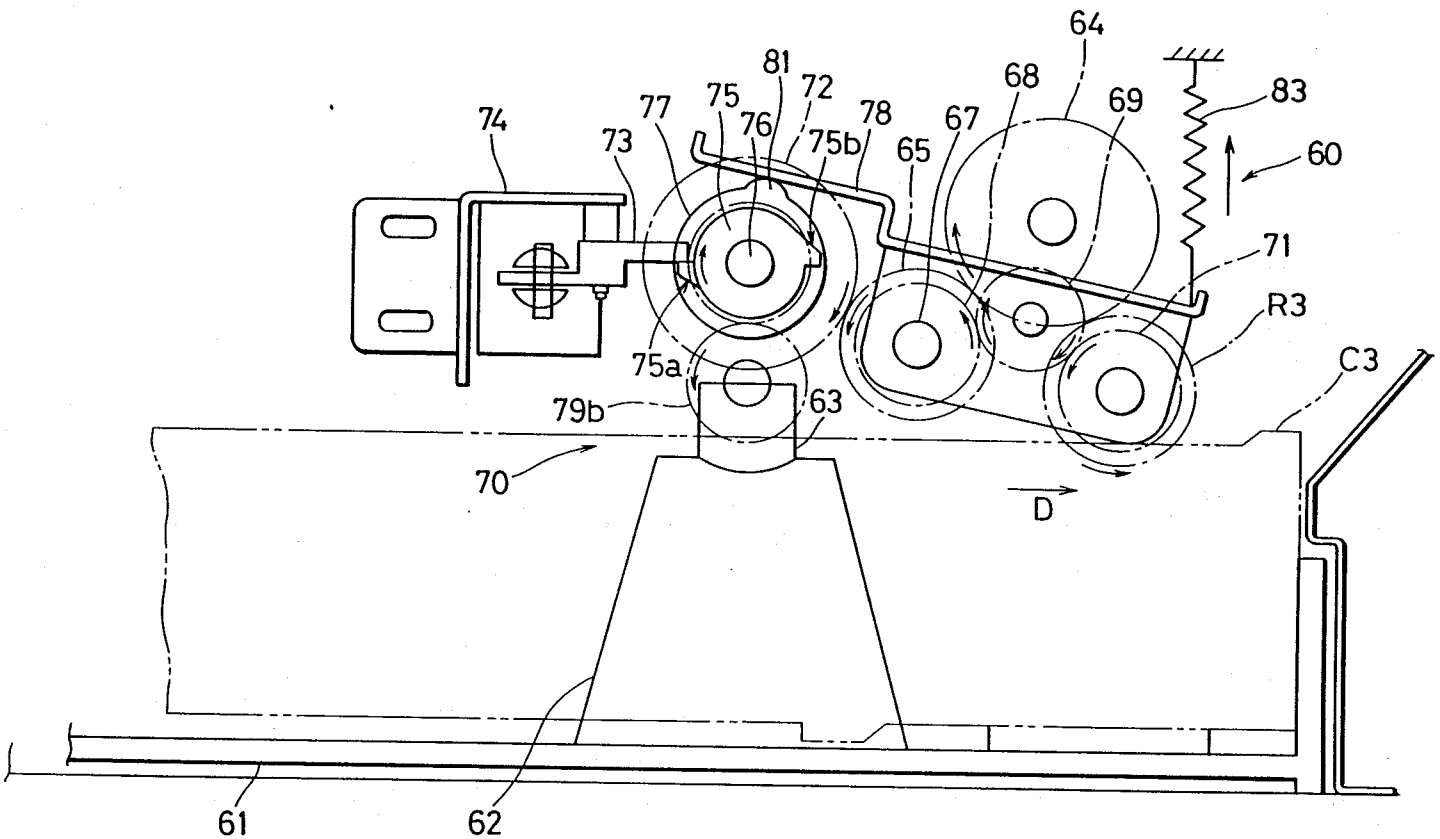
FIG. 4 is a lateral view of the essential constituents shown in FIG. 3.

Since the claw 75*b* is disengaged from the lever 73 while the lever 73 oscillates, the spring clutch 75 is activated to rotate in the direction of the arrow until the other claw 75*a* in the position opposite claw 75*b* is eventually engaged with the lever 73. As soon as the claw 75*a* is engaged with the lever 73 as shown in FIG. 4, the spring clutch 75 stops rotating, thus the spring clutch 75 makes a half turn and stops. This also causes the cam 77 and the gear 79*a* secured t shaft 76 to respectively make a half turn. The projection 81 on the cam 77 then comes into contact with the bottom surface of the edge portion of the oscillating plate 78 so that the position of this plate 78 can be raised. This causes the paper-feeding roller R3 of the paper-feeding section 60 to descend itself until it comes into contact with the upper surface of the copying paper P to allow the copying paper P to be delivered to the copying section 4.

On the other hand, as a result of a one-half turn of the shaft 76, he gear 79*a* causes the stopper 63 to make a half turn via the gear 79*b* until the stopper 63 stops at a specific position to be engaged with the engaging plate 62 of the paper-feeding cassette mount 61. As a result, the paper-feeding cassette mount 61 cannot mechanically be drawn out of the copying apparatus 1. Consequently, as soon as the paper-feeding roller R3 starts to feed the copying papers, the paper-feeding cassette C3 mounted on the paper-feeding cassette mount 61 is securely inhibited from being drawn out of the paper-feeding device 3*b*. This eventually allows the operator to save the copying paper being processed by the copying apparatus 1, and at the same time, securely prevents the copied paper P from jamming itself in the paper-feeding path 53.

When completing the paper-feeding operation, the controller of the copying apparatus 1 outputs a paper-feeding stop timing signal to the paper-feeding clutch 66 and the solenoid 74. On receipt of this signal, the paper-feeding clutch 66 turns OFF to stop the rotations of the shaft 67 and the paper-feeding roller R3. Then the paper P is not fed to the paper-feeding path 53, on the other hand, as soon as the paper-feeding clutch 66 turns OFF, the solenoid 74 activates, thus causing the lever 73 engaged with the claw 75*a* of the spring clutch 75 to oscillate in the direction of the arrow so that it can perform a reciprocating movement before stopping at the original position. This causes the shaft 76 to make a half turn, and as a result, the cam 77 and the gear 79*a* secured to the shaft 76 also rotate by half a turn. Then, the projection 81 on the cam 77 leaves the bottom surface of the edge portion of the oscillating place 8 to allow the return spring 83 to pull the oscillating plate 78. As a result, the paper-feeding roller R3 of the paper-feeding section 60 leaves the upper surface of the copying paper P.

On the other hand, as described earlier, since the stopper 63 is driven by half a turn in conjunction with the half-turn of the shaft 76, the stopper 63 is disengaged from the engaging plate 62, thus eventually allowing the paper-feeding cassette mount 61 to freely be drawn out of the copying apparatus 1.

The above preferred embodiment of the paper-feeding device according to the present invention is comprised of the constitution in which the solenoid 74 is driven by the paper-feed timing signal from the controller to cause the shaft 76 to make a half turn, thus allowing the stopper 63 mechanically connected to the shaft 76 to move so that it can be engaged with the engaging plate 62. However, it should be understood that the scope of the preferred embodiment of the paper-feeding device according to the invention is not limited to the constitution mentioned above. For example, it is also possible for the paper-feeding device to allow the stopper 63 to directly move into engagement with the engaging plate 62 by direct connection will to a solenoid which can be operated by delivering the paper-feed timing signal to it from the controller. Likewise, the preferred embodiment cited above inhibits the paper-feeding cassette C3 from being extracted by causing the engaging plate 62 secured to the paper-feeding cassette mount 61 to be engaged with the stopper 63. Furthermore, it is also possible for the paper-feeding device to prevent the paper-feeding cassette C3 from being extracted by directly securing the engaging plate 62 to the paper-feeding cassette C3 to cause the engaging plate 62 to be engaged with the stopper 63.

Figure 5:
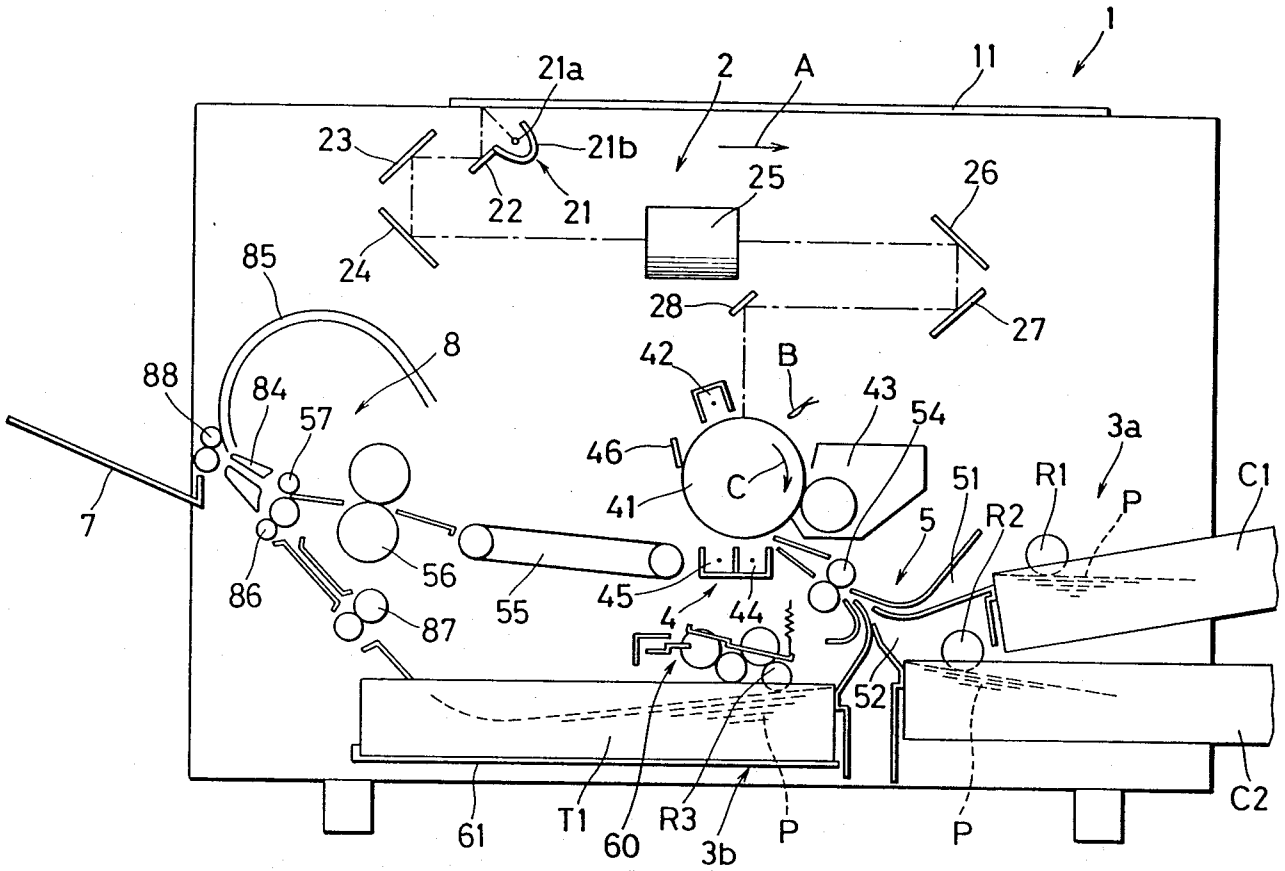
FIG. 5 is a simplified block diagram of a duplex copying apparatus incorporating a preferred embodiment of the paper-feeding device according to the invention.

The paper-feeding device according to the invention is also applicable to a duplex image processing apparatus having an additional mechanism for allowing the image-formed paper to be delivered to a paper-feeding cassette (hereinafter called as an interim tray T1 when the cassette is made available for a duplex image processing apparatus) along the reverse-conveying path provided inside of the duplex image processing apparatus, and then, allowing the image-formed paper to provisionally be stored in the interim tray T1 before again feeding this paper to the copying section 4. The duplex copying apparatus is provided with a second paper-conveying section 8 at the left specific position inside of the image processing apparatus 1 for feeding the image-formed paper to the paper-feeding device 3*b* as shown in FIG. 5 for example. The second paper-conveying section 8 is comprised of a claw 84 needed for switching the branching paths, reverse-conveying path 85, reverse-feeding roller 86, reverse-conveying roller 87, the interim tray T1 which can be drawn out of the front surface of the duplex copying apparatus, and the paper-feeding section 60, respectively. When copying the images of the original document on both surfaces of the copying paper, the claw 84 raises the position of the once image-formed paper which is conveyed by the roller 57. The paper is then delivered to the reverse-conveying path 85 and again drawn out of this path 85 by the reverse-feeding roller 86 before being delivered to the interim tray T1 through the reverse-conveying roller 87. After storing a specific number of the image-formed papers inside of the interim tray T1, if it is necessary to feed the image-formed papers from the interim tray T1 for copying an image on the opposite surfaces of these papers, the duplex copying apparatus allows the paper-feeding section 60 to draw out these papers before delivering them to the registration roller 54 to reverse their surfaces. It is also possible for the duplex copying apparatus to deliver the image-formed papers to the tray 7 without forming an image on the other surface by allowing the claw 84 to directly lead these papers to the paper-discharging roller 88. Consequently, the cassette-mount locking device comprised of the stopper 63 and the engaging plate 62 can effectively be applied to the interim tray T1 of the preferred embodiment shown in FIG. 5 to enable this embodiment to securely achieve the desired effect equivalent to that achieved by the first preferred embodiment shown in FIG. 1.

The above description has referred to a preferred embodiment of the paper-feeding device which inhibits the extraction of the paper-feeding cassette removably loaded in the paper-feeding cassette mount in the direction 90 degrees apart from the paper-conveying direction. However, the present invention is also applicable to the paper-feeding device which inhibits the extraction of any conventional paper-feeding cassette like the cassettes C1 and C2 shown in FIG. 1, which are removably loaded in the cassette-mount in the direction parallel with the paper-conveying direction.

Paper-Feeding Cassette

Next, referring now to the preferred embodiment shown in FIG. 1, the disposition of the paper-feeding cassettes C1 through C3 is described below. As mentioned in the preceding description, since any of these cassettes C1 through C3 can optionally be loaded into either the paper-feeding section 3*a* or 3*b*, any of these cassettes can optionally be selected (i.e., cassette C3 has been selected for the preferred embodiment shown in FIG. 1 for example) for mounting it on the paper-feeding cassette mount 61 of the pull-out type paper-feeding device 3*b* before inserting the cassette mount 61 into the copying apparatus 1. The remaining cassettes C1 and C2 can be loaded into the multiple-cassette type paper-feeding device 3*a*. Since the pull-out type paper-feeding device 3*b* loads and unloads the cassette C3 into and from the front of the copying apparatus 1, an operator can easily replenish copying papers P into the cassette C3 by mounting this cassette storing copying papers having a specific size in good demand onto the pull-out type paper-feeding device 3*b*. Since the paper-feeding device according to the invention allows the operator to optionally load any of these paper-feeding cassettes C1 through C3 or choose any of these according to the actual needs, it offers practical convenience to the operator.

In addition to the multiple-cassette type paper-feeding device 3*a*, since the image processing apparatus is also provided with the pull-out type paper-feeding device 3*b*, the operator can optionally choose sizes of copying papers from a wide variety. Furthermore, since the paper-feeding device according to the invention allows the operator to use any of those conventional paper-feeding cassettes for making up the paper-feeding cassettes C1 through C3, even when replacing the used copying apparatus with a new one like the copying apparatus incorporating the preferred embodiments of the invention, the investment cost can be saved by effectively using those conventional paper-feeding cassettes on hand. Likewise, since the paper-feeding cassettes can commonly be made available, manufacturers can also lower the production cost.

Note that the constitution of the paper-feeding cassettes C1 through C3 is not limited to the above preferred embodiments. If at least a paper-feeding device needs to be loaded into the multiple-cassette type paper-feeding device 3*a* for example, then, the paper-feeding cassette may be like the one having a manual tray in part of the constitution for example. It is also possible for the preferred embodiment to modify the design of the paper-feeding device to either increase or decrease the number of the paper-feeding cassettes to be mounted on the multiple-cassette type paper-feeding device 3*a*.

Figure 6:
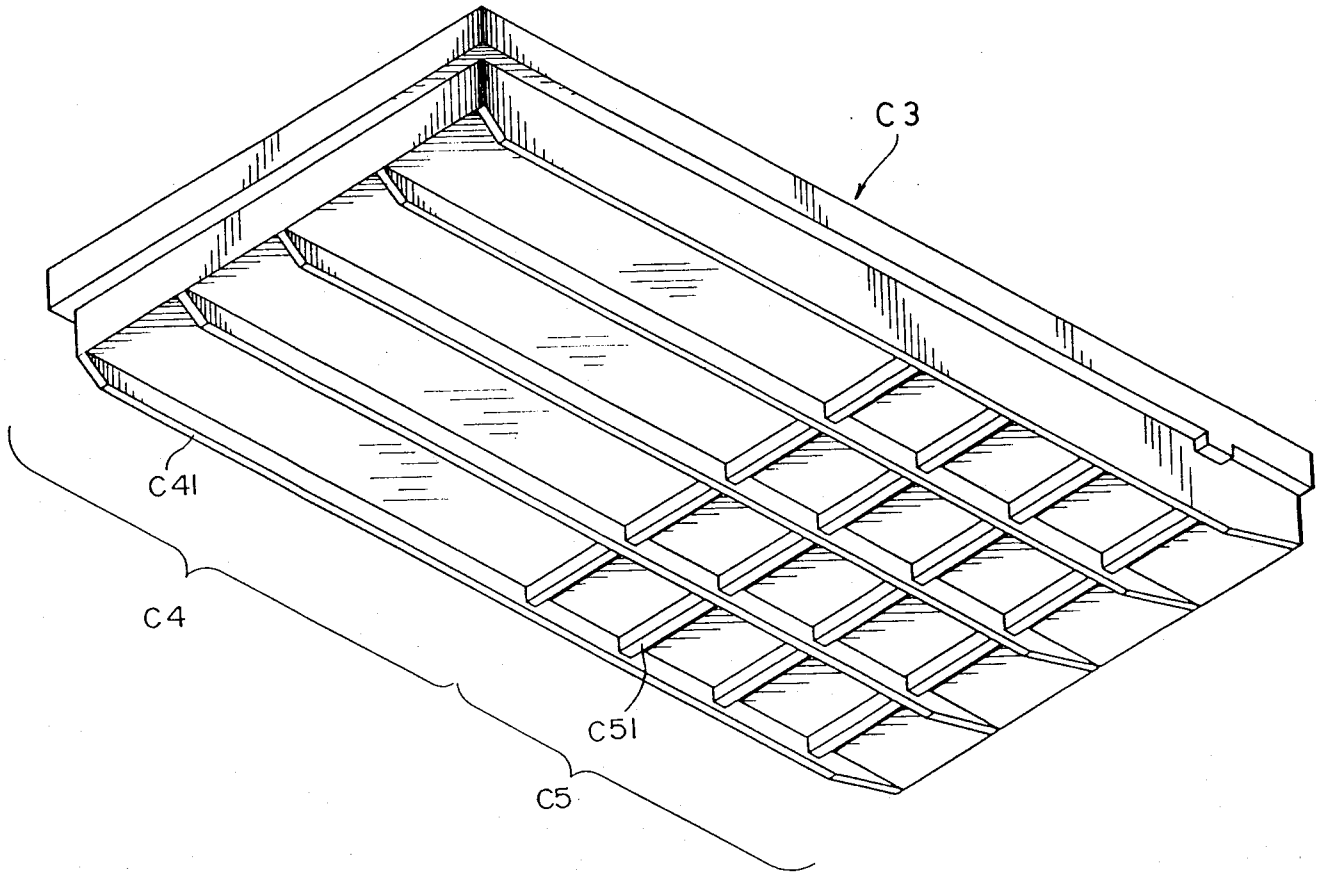
FIG. 6 is a perspective view of the bottom surface of the paper-feeding cassette according to the invention.

Next, a modified version of the preferred embodiment of the paper-feeding device shown in FIG. 1 is described below. FIG. 6 is the overall perspective view of the paper-feeding cassettes C1 through C3. To reinforce the strength of these cassettes, a plurality of ribs C41 and C51 are provided on the bottom surfaces of these cassettes C1 through C3, respectively. A cross striped projection C5 is formed by a plurality of ribs C41 and C51 on the paper-feeding side, and in addition, parallel striped portion C4 is formed by ribs C41 at a specific position opposite from the paper-feeding side.

Figure 7:
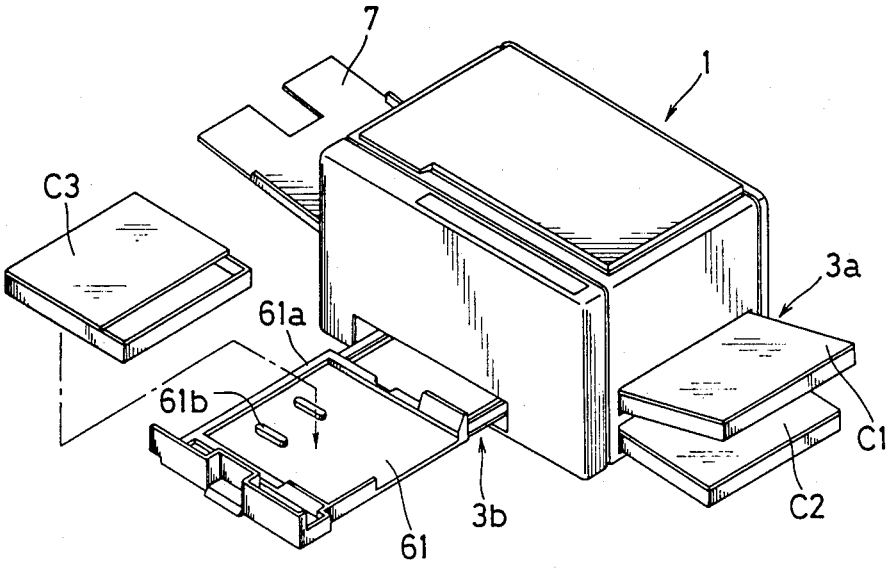
FIG. 7 is a perspective view of the electrophotographic copying apparatus allowing insertion of the paper-feeding device shown in FIG. 6.

To mount a desired paper-feeding cassette chosen from those paper-feeding cassettes C1 through C3 onto the pull-out type paper-feeding device 3*b*, the paper-feeding cassette mount 61 is provided with a positioning frame 61*a* for allowing each of these cassettes C1 through C3 to be set to the predetermined position and a direction-control projection member 61*b* for preventing the paper-feeding cassette from being loaded in the reverse direction, as shown in FIG. 7. The direction control member 61*b* should be provided with a specific height which is lower than that of the rib C41 on the bottom surfaces of those paper-feeding cassettes C1 through C3, and yet, the height of the direction control member 61*b* is preferably very close to that of the rib C41. The position and the dimension needed for the direction control member 61*b* should carefully be determined, where the paper-feeding cassette should correctly be set to the place in which the direction control member 61*b* is positioned between ribs C41 which form the parallel striped portion C4, whereas if the paper-feeding cassette were mounted in the wrong direction, the direction control member 61*b* should come into contact with the rib C51 which makes up the cross striped projection C5.

Next, a method of mounting the paper-feeding cassette having the constitution mentioned above is described below. The operator can optionally select any of those paper-feeding cassettes C1 through C3 (cassette C3 has been chosen in the preferred embodiments shown in the drawings for example) and set it in a position in order that the selected cassette C3 can be stored inside of the frame 61*a* of the paper-feeding cassette mount 61. If the cassette C3 were set in the direction opposite to the correct direction, i.e., if the paper-feeding side and the opposite side is reversed, then, the ribs C51 of the cross striped projection C5 on the bottom surface of the paper-feeding cassette C3 comes into contact with the direction-control member 61*b*, thus the operator is aware that the cassette is incorrectly mounted. After correcting the direction of the paper-feeding cassette C3, the direction-control member 61*b* enters itself between ribs C41 of the parallel striped portion C4. Then, the bottom of the cross striped projection C5 comes into contact with the paper-feeding cassette mount 61. While this condition is present, the selected cassette C3 can be loaded into the predetermined position of the paper-feeding device 3*b* by allowing the cassette mount 61 to be inserted into the copying apparatus 1. The remaining paper-feeding cassettes C1 and C2 are respectively loaded into the multiple-cassette paper-feeding device 3*a*.

Figure 8:
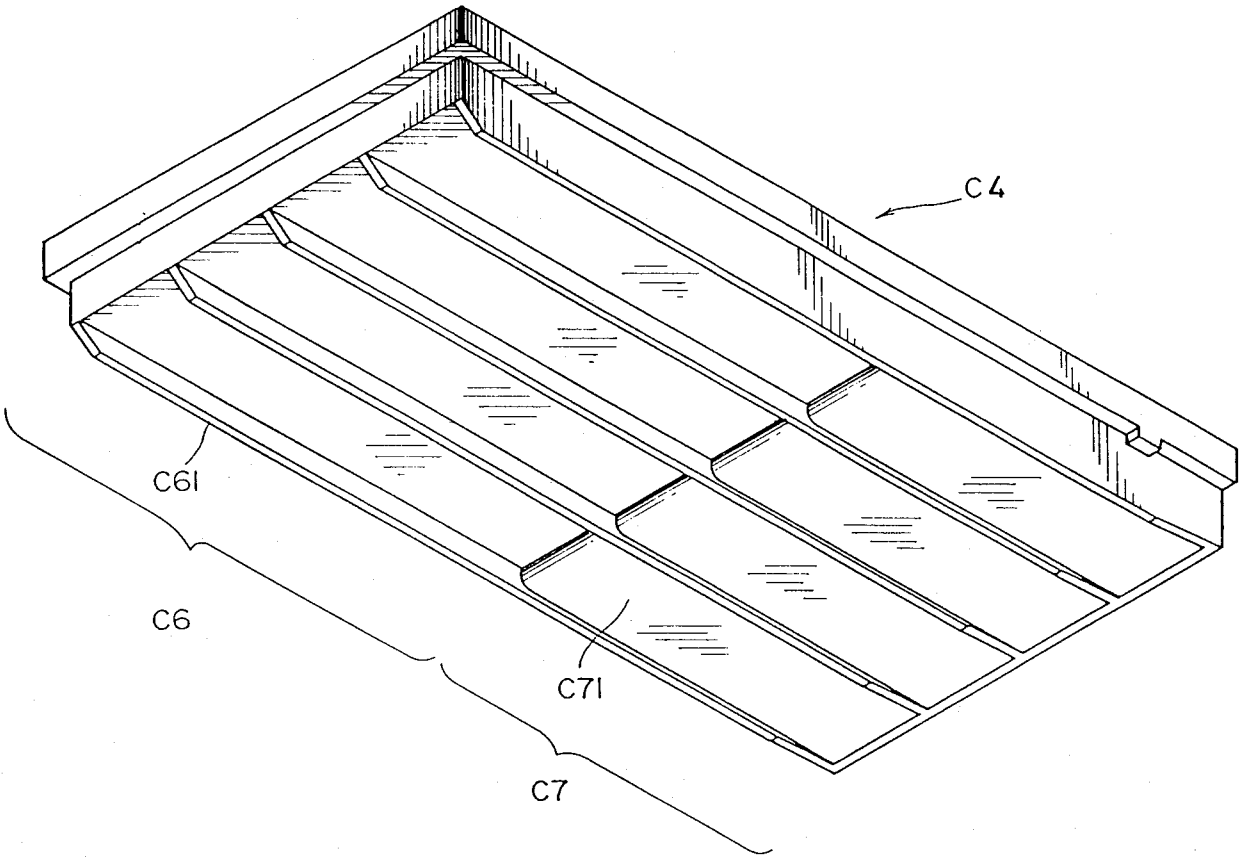
FIG. 8 is a perspective view of another bottom surface of the paper-feeding cassette according to the invention.

FIG. 8 is a perspective view of the bottom surface of another preferred embodiment of the paper-feeding cassette shown in FIG. 6. A parallel striped portion C6 having a plurality of ribs C61 disposed in the striped form are provided in the predetermined positions opposite to the paper-feeding side on the bottom surface of the paper-feeding cassette C4, whereas a projected surface C7 having a projection C71 is provided on the paper-feeding side. Consequently, the paper-feeding device according to the above preferred embodiment of FIG. 8 prevents the operator from setting the paper-feeding cassette in the wrong direction by providing the projected surface C7 in place of the cross striped projection C5 shown in FIG. 6. Furthermore, since the bottom surfaces of these paper-feeding cassettes shown in FIGS. 6 and 8 are merely provided with the parallel striped ribs C41 and C61 on the sides opposite to the paper-feeding side, the operator can manually and smoothly insert any of these paper-feeding cassettes C1 through C3 by holding his fingers on a portion between each of ribs C41 or each of C61. The operator can also easily extract the paper-feeding cassette from the paper-feeding cassette mount 61 with his fingers inserted through a space formed between the bottom surface of the cassette and the upper surface of the cassette mount 61.

As mentioned above, since the paper-feeding cassette mount 61 is provided with the direction control member 61*b* for controlling the cassette mounting direction, and the projections are provided for each paper-feeding cassette, if the operator loads the paper-feeding cassette in the reverse direction, these projections come into contact with the direction control member 61*b* to allow the operator to easily identify that the cassette has been inserted in the reverse direction. A number of ribs C41 through C71 provided on the bottom surface effectively reinforce the strength of the paper-feeding cassette itself. Furthermore, since these paper-feeding cassettes C1 through C3 employed for the above preferred embodiment are respectively provided with a number of ribs having shapes different from those which are on the bottom surface of any conventional paper-feeding cassette, those paper-feeding cassettes C1 through C3 can effectively be applied to the cassette mount for loading any conventional paper-feeding cassette as well. Consequently, the paper-feeding device according to the invention allows the use of any conventional paper-feeding cassette as well as those cassettes C1 through C3.

Inserted-Cassette Detection Device

Next, a device for detecting the presence and absence of the paper-feeding cassette mount 61 inserted into the predetermined position of the image processing apparatus is described below. Today, any conventional image processing apparatus like an electrophotographic copying machine is provided with a paper-size identifying member at the tip portion of the paper-feeding cassette insertion side to indicate the size of the copying papers loaded in the paper-feeding cassette. On the other hand, the paper-feeding device is provided with a paper-size detecting device detecting the content of the paper-size identifying member. The paper-size identifying member is substantially comprised of a magnetic piece set to one of specific positions each corresponding to sizes of the copying papers. On the other hand, the paper-size detecting device is substantially comprised of a magnetic sensor sensing the presence of magnetism. Using these, when the paper-feeding cassette is loaded in the image processing apparatus, the size of the copying paper is detected. At the same time, since the paper-size identifying member is set at the tip portion of the paper-feeding cassette insertion side, it can be identified that the paper-feeding cassette is set to the predetermined position. After identifying this, the controller releases the image processing apparatus from the state of inhibiting the copying operation. However, since the operator loads and unloads the paper-feeding cassette C3 shown in FIG. 1 through the front of the copying machine, there is a problem to be solved, which is described below.

Figure 9:
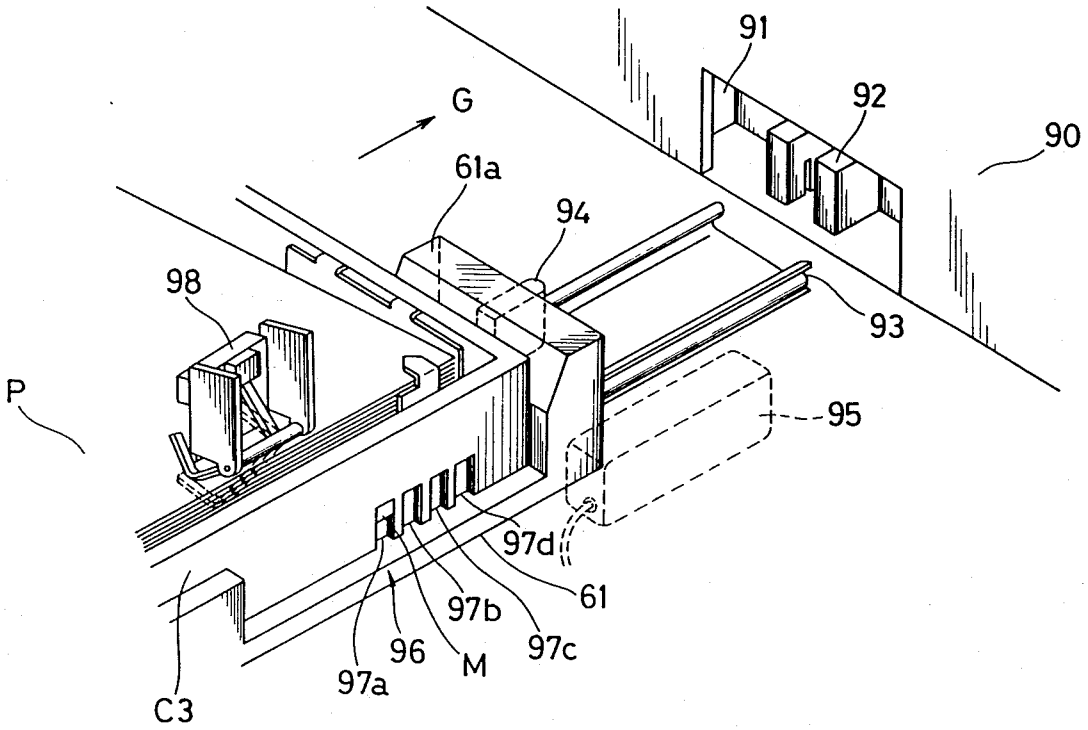
FIGS. 9 and 9A are perspective views of paper-feeding devices which are provided mechanisms for identifying that the inserted paper feeding-cassette mount is exactly at the predetermined position.

Concretely, when inserting the paper-feeding cassette C1 and C2 into the paper-feeding device 3*a*, these are vertically inserted, i.e., in a paper-conveying direction. Conversely, when inserting these cassettes into the paper-feeding device 3*b*, since the copying paper is conveyed in the direction 90 degrees apart from the cassette-inserting direction, these cassettes should be inserted in the lateral direction. As a result, as shown in FIG. 9, the direction of the arrangement of cutout portions 97*a* through 97*d* for mounting a magnetic piece M matches the cassette-inserting direction denoted by arrow G of FIG. 9. Consequently if the paper-feeding cassette is not fully inserted in the predetermined position, then, the paper-size detector 95 will erroneously detect a position of the magnetic piece M to detect a false paper-size. Further there arises a greater problem. If the paper-size detecting device 95 and the magnetic piece M are utilized so as to detect whether the paper-feeding cassette has been inserted to the predetermined position or not, a paper is fed with the paper-feeding cassette not fully inserted, incurring a paper jamming.

To prevent this, the preferred embodiment shown in FIG. 9 provides a projection 94 at the tip portion of the positioning frame 61*a* to cause the projection 94 to activate the cassette-position detecting switch 92 of the copying machine 1 as soon as the paper-feeding cassette mount 61 is inserted into the predetermined position. This eventually allows the controller to identify that the paper-feeding cassette mount 61 is exactly in the designated position.

More particularly, as shown in FIG. 9, the positioning frame 61*a* provided in the portion surrounding the paper-feeding cassette mount 61 has a projection 94 which is substantially the objective member to be detected at the tip portion of the cassette mount 61 in the cassette-inserting direction, i.e., in the direction of arrow G. An aperture 91 is provided for the frame 90 secured to the copying machine 1 at the position opposite to the projection 94. A photo-interrupter type position detecting switch 92 is provided in the center-bosom of the aperture 91. A plurality of the cutout portions 97*a* through 97*d* each corresponding to the sizes of copying papers to be stored in the cassette and a paper-size identifying member 96 comprised of the magnetic piece M set inside of any of those cutout portions 97*a* through 97*d* are respectively provided on the lateral surface of the paper-feeding cassette C3. A paper-size detector 95 using a magnetic sensor is disposed in a position on the frame 90 of the copying machine 1 facing the cutout portions 97*a* through 97*d*. It is also possible for the preferred embodiment shown in FIG. 9 to dispose the paper-size detector 95 on the lateral surface of the paper-feeding cassette C3 and the paper-size identifying member 96 on the frame 90 of the copying machine 1. A paper-detecting switch 98 detecting the presence or the absence of copying paper is set to the upper surface of the paper-feeding cassette C3. When the paper-feeding cassette mount 61 loaded with paper-feeding cassette C3 storing copying papers is inserted into the predetermined position by the sliding movement on rail 93, the projection 94 enters itself into the detectable portion of the detecting switch 92 to allow this switch 92 to generate a signal advising that the paper-feeding cassette mount 61 is fully inserted into the copying machine 1. Simultaneously, the paper-size detector 95 detects the presence of the magnetic piece M set to the paper-size identifying member 96 and then generates a paper-size detected signal. Then, the paper-detecting switch 98 identifies whether the copying paper is present, or not. If the copying papers are stored in the paper-feeding cassette C3, then the switch 98 generates a copying-paper detected signal. Only after identifying the receipt of these three signals, the controller releases the copying machine 1 from the state of inhibiting the paper-feeding operation.

Figure 9A:
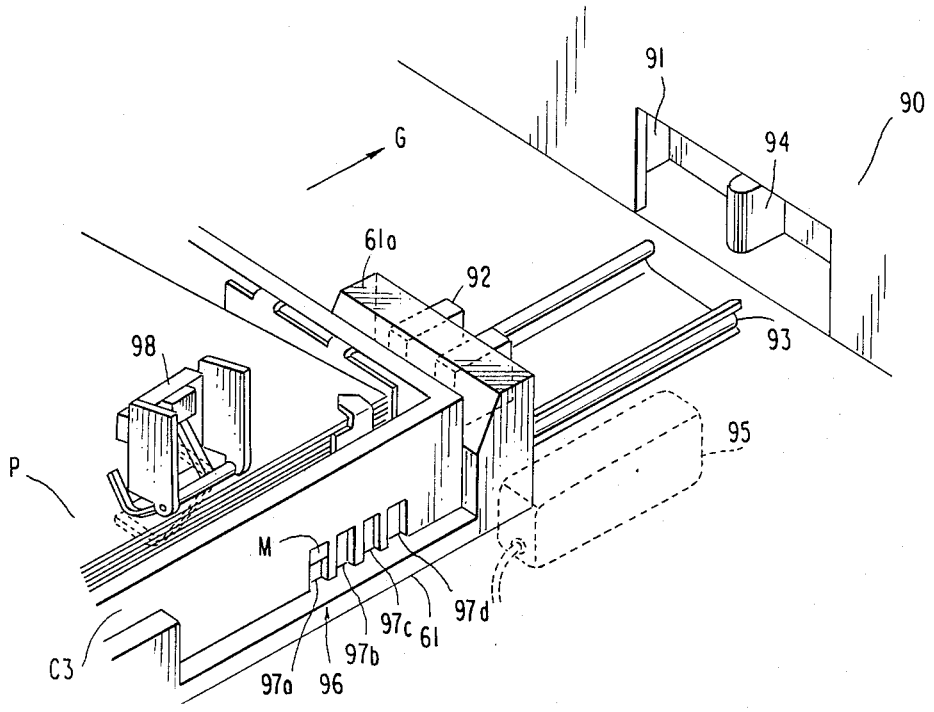

FIG. 9A shows an alternative preferred embodiment wherein the detecting switch 92 is provided on the positioning frame 61*a* of the cassette mount 61. A member 94 which is detectable by the switch 92 is provided in the center-bosom of the aperture 91 in the frame 90.

A paper-size display device (not shown) of the copying machine 1 does not accept the paper-size detected signal from the paper-size detector 95 until the cassette-position detecting switch 92 eventually outputs the cassette-position detected signal. Only after the cassette mount 61 is fully inserted into the predetermined position, the content of the paper-size detected signal is shown in the paper-size display device of the copying machine 1. This allows the operator to check to see if the cassette C3 is fully inserted into the predetermined position, or not. If the cassette mount 61 is not in the predetermined position, then, the cassette-position detecting switch 92 does not output the cassette-position detected signal, thus preventing the controller from allowing the copying machine 1 to enter into the copying-ready state. This in turn securely prevents the paper-feeding operation from being activated by erroneous detection of the cassette position likely to take place with any of the conventional front pull-out type paper-feeding devices which may activate the paper-feeding operation even when the paper-feeding cassette is not yet fully inserted into the predetermined position. Likewise, since the operator can read the content of the paper-size display in the state in which the paper-feeding cassette C3 is exactly in the predetermined position, the operator can correctly detect the actual size of the paper-feeding cassette C3.

Another Preferred Embodiment of the Paper-Feeding Device

Referring now more particularly to FIGS. 10 through 13, another preferred embodiment of the paper-feeding device related to the present invention is described below.

The paper-feeding device reflecting this preferred embodiment is substantially the one conventionally called "front pull-out" type having the paper-feeding cassette which is completely loaded inside of the image processing apparatus, while the typical of which is cited in the Unexamined Japanese Utility-Model Publication No. 63845/1985. The paper-feeding cassette mounted on the paper-feeding cassette mount is loaded inside of the copying machine through the front port to allow it to be unloaded from the front as well. Copying papers stored in the paper-feeding cassette are drawn out by the paper-feeding roller of the copying machine in the direction 90 degrees apart from the cassette-extraction direction before being delivered to the copying section. Since the paper-feeding cassette is completely stored inside of the copying machine, compared to any conventional copying machine loaded with the paper-feeding cassette having specific portions projecting from the lateral side of the copying machine, the front pull-out type copying machine saves the floor space required for the installation, thus promoting the utility efficiency of limited space in an office.

Figure 11:
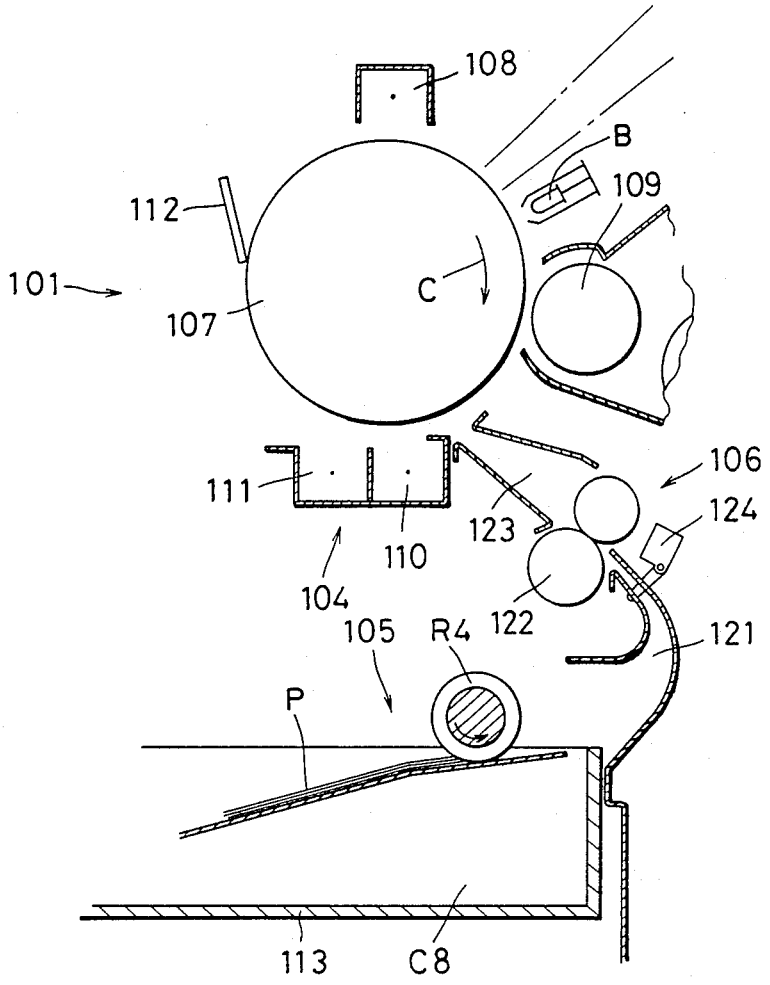
FIG. 11 is a simplified block diagram denoting the essential constituents inside of the electrophotographic copying apparatus shown in FIG. 10.

FIG. 11 denotes the essential constituents inside of the copying machine having a paper-feeding device featuring the constitution mentioned above. The copying section 104 generating the image on the copying paper P is disposed in a predetermined stationary position inside of the copying machine. A paper-feeding device 105 which draws out each piece of copying papers of specific size from a paper-feeding cassette C8 is disposed at a predetermined position beneath the copying section 104. The copying-paper conveying section 106 for conveying the copying paper P drawn out of the paper-feeding cassette C8 to the copying section 104 is provided between the copying section 104 and the paper-feeding device 105. The copying section 104 is comprised of the following constituents provided in the periphery of the photoreceptive drum 107 rotating itself in the direction C, where these constituents are disposed in the order of a corona discharger 108, blank lamp B, developing device 109, transferring corona discharger 110, separation corona discharger 111, and cleaner 112. The blank lamp B eliminates the static charge from the external circumferential surface of the photoreceptive drum 107 which is uniformly charged by the corona discharger 108, and then, an image of the original document is formed on portions where residual electrostatic charge is present in order that the static latent image can be formed. Then, the developing device 109 develops the static latent image into a toner image, which is then transferred onto the copying paper P by means of the transferring corona discharger 110. Finally, the residual toner is collected by the cleaner 112.

The paper-feeding device 105 is comprised of a paper-feeding cassette C8 which is removably loaded in the copying machine 101 through the front port, a paper-feeding roller R4 extracting the copying paper from the paper-feeding cassette C8, and a paper-feeding cassette mount 113 mounting the paper-feeding cassette C8, respectively. To extract the paper-feeding cassette C8 in the direction of the front of the copying machine 101, the paper-feeding cassette mount 113 is provided in the manner of freely sliding its position in the direction of arrow H shown in FIGS. 10 and 12 from the bosom to the front port of the copying machine 101 by a predetermined stroke.

The copying-paper conveying section 106 is comprised of a first paper-feeding path 121 which delivers the copying paper P extracted from the paper-feeding cassette C8 to the registration roller 122 and a second paper-feeding path 123 which delivers the copying paper P extracted from the resist roller 122 to a predetermined position between the photo-receptive drum 107 and the transferring corona discharger 110. A photo-interrupter type paper-passage detecting switch 124 confirming the passage of the copying paper P is disposed at the midpoint of the paper-feeding path 121.

Figure 12:
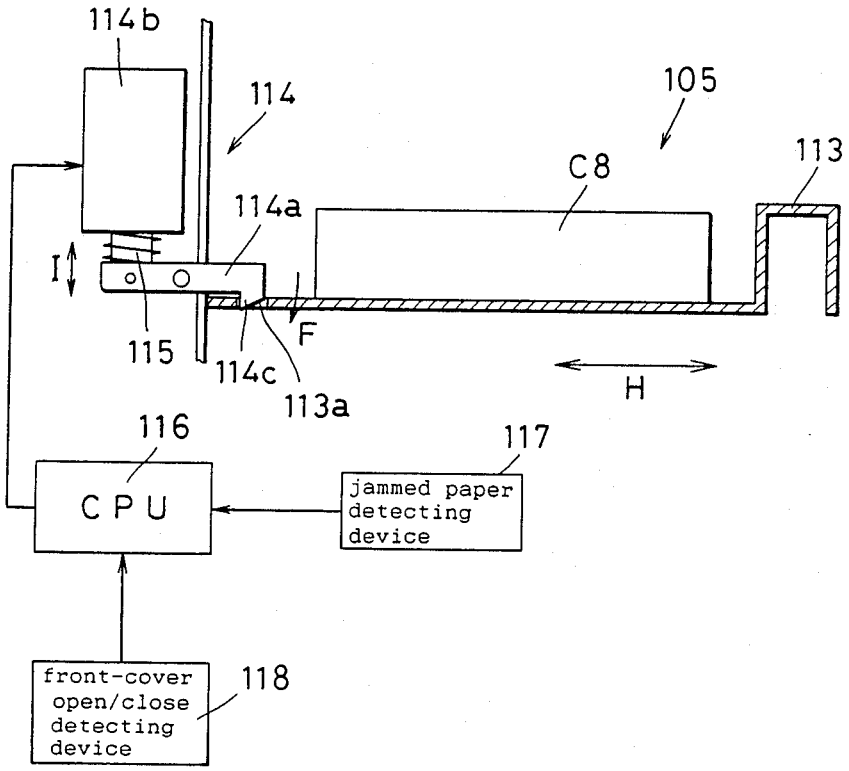
FIG. 12 is a simplified block diagram of the paper-feeding device incorporating locking means according to the invention.

A locking device 114 inhibiting the extraction of the paper-feeding cassette C8 is disposed in a specific position of the paper-feeding device 105 such as the bosom of the insertion space receiving the paper-feeding cassette C8, as shown in FIG. 12, so that the cassette C8 can be prevented from being drawn out of the coping machine 101 if the copying paper P jams up itself in the first paper-feeding path 121 after being delivered from the cassette C8. The locking device 114 is comprised of a stopper 114*a* which is disposed in a specific position inside of the copying machine 101 in order that it can freely rotate and a solenoid 114*b* for rotating the stopper 114*a*. When the solenoid 114*b* rotates the stopper 114*a* in the direction I shown in FIG. 12, an engaging claw 114*c* at the tip portion of the rotating stopper 114*a* is engaged with the engaging hole 113*a* provided in the paper-feeding cassette mount 113 to prevent the cassette mount 113 and the cassette C8 from respectively being drawn out of the copying machine 101. Conversely, the locking device 114 allows the cassette C8 to be drawn out of the cassette mount 113 by reversing the rotation of the stopper 114*a*, where the stopper 114*a* is rotated in the reverse direction by applying an elastic member like coil spring 115 for example.

The solenoid 114*b* is connected to a microprocessor 116 controlling the operation of this solenoid. Likewise, the microprocessor 116 is connected to a jammed-paper detecting device 117 for detecting jammed paper in the first paper-feeding path 121 and a front cover open/close detecting device 118 for detecting the open or closed front cover 119 (shown in FIG. 10) of the copying machine 101. A signal output from the paper-passage detecting switch 124 is delivered to the jammed-paper detecting device 117. This signal allows the detecting device 117 to sense either the presence or the absence of the jammed paper in the first paper-feeding path 121 by checking whether the detecting switch 124 has detected the passage of the copying paper P or not within a lapse of a predetermined time after the paper-feeding device 105 is actuated. The front-cover open/close detecting device 118 detects whether the front cover 119 is open or closed in response to a signal from a microswitch which is activated by the opening or the closing operation of the front cover for example. Since the front-cover open/close detecting device 118 is conventionally used, further description is omitted.

In response to the jammed-paper detected signal output from the jammed-paper detecting device 117, the microprocessor 116 activates the operation of the solenoid 114*b* of the locking device 114 to inhibit the extraction of the paper-feeding cassette C8, and at the same time, in response to the front-cover open-or-closed detected signal from the front cover open/close detecting device 118, the microprocessor 116 releases the solenoid 114*b* from the operative state, i.e., the microprocessor 116 allows the paper-feeding cassette C8 to be drawn out of the copying machine 101.

Figure 13:
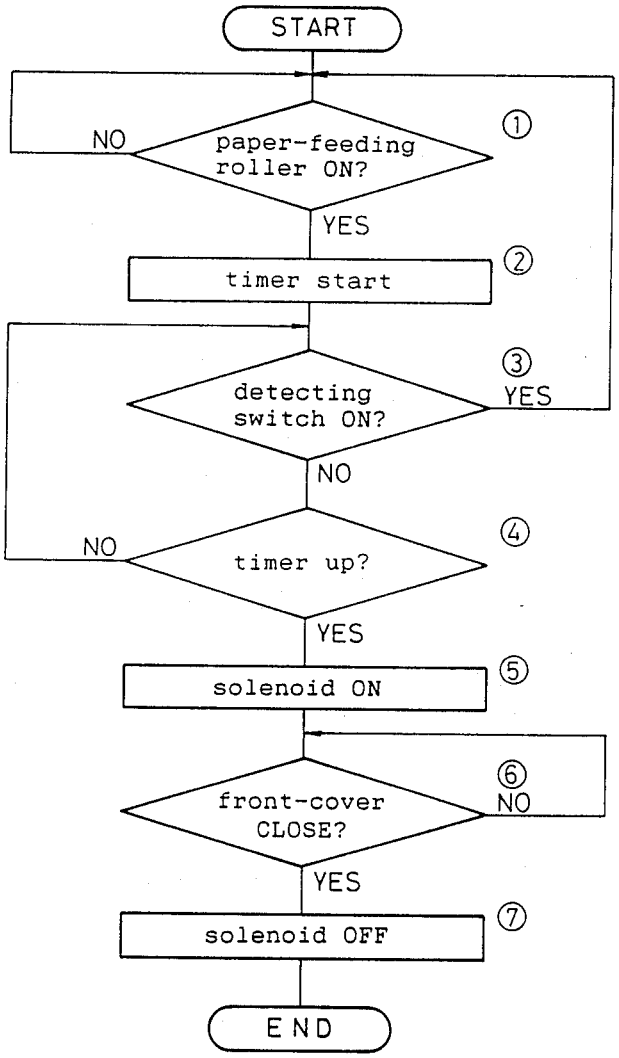
FIG. 13 is an operation flowchart denoting the locking procedure executed by the paper-feeding device according to the invention.

FIG. 13 is an operation flowchart denoting the control procedure executed by the microprocessor 116. As soon as the copying paper P is delivered from the paper-feeding cassette C8 during step 1, a timer inside of the microprocessor 116 is activated during the following step 2. If the detecting switch 124 detects the passage of the copying paper P until the predetermined period of time elapses while step 4 is underway, then, the operation mode returns from step 3 to step 1. If the detecting switch 124 does not detect the passage of the copying paper P, the microprocessor 116 then identifies that the copying paper is jammed. This causes the operation mode to proceed to step 5 to activate the operation of the solenoid 114*b*, thus allowing the locking device 114 to inhibit the extraction of the paper-feeding cassette C8 from the image processing apparatus 101. Consequently, any unwanted trouble can securely be prevented from occurrence, for example, inability to extract the cassette C8 from the copying machine 101 due to the presence of the jammed paper between the cassette C8 and the copying machine 101, or inability to remove the torn-up jammed paper on the halfway of the first paper-feeding path 121. If the copying paper P jams on the way, then, the operator manually opens the front cover 119 of the copying machine 101 to remove the jammed paper by manually rotating the paper-feeding roller R4 for example. Then, the operator manually closes the front cover 119 (during step 6) to reactivate the operation of the locking device 114 during step 7 before allowing the cassette C8 to eventually be extracted from the machine 101. Note that the operator may also reactivate the operation of the locking device 114 during step 6 by opening the front cover 119.

The paper-feeding device 105 reflecting the present embodiment also allows the locking device 114 to inhibit the extraction of the paper-feeding cassette C8 from other outlets like the portion beneath the paper-feeding cassette mount 113 for example. It is also possible for the above preferred embodiment to inhibit the removal of the cassette mount 113 by applying a locking pin driven forward and backward with use of the solenoid 114*b* in place of the stopper 114*a* or by releasing the locking device 114 by applying a reset signal generated by the reset switch for releasing the copy-prohibiting state In summary, by effectively operating the locking device 114, the paper-feeding device 105 applied to the above preferred embodiment securely prevents the paper-feeding cassette C8 from being drawn out of the copying machine 101 when the copying paper P jams while delivering the copying paper P from the cassette C8. Consequently, any unwanted trouble can securely be prevented from occurrence, for example, inability to extract the paper-feeding cassette C8 from the copying machine 101 due to the presence of the jammed paper between the cassette C8 and the copying machine 101, or inability to remove the torn-up jammed paper on the halfway of the paper-feeding path 121. The paper-feeding device 105 reflecting the above preferred embodiment eventually allows the operator to smoothly remove the jammed paper from the paper-feeding path 121.

Figure 10:
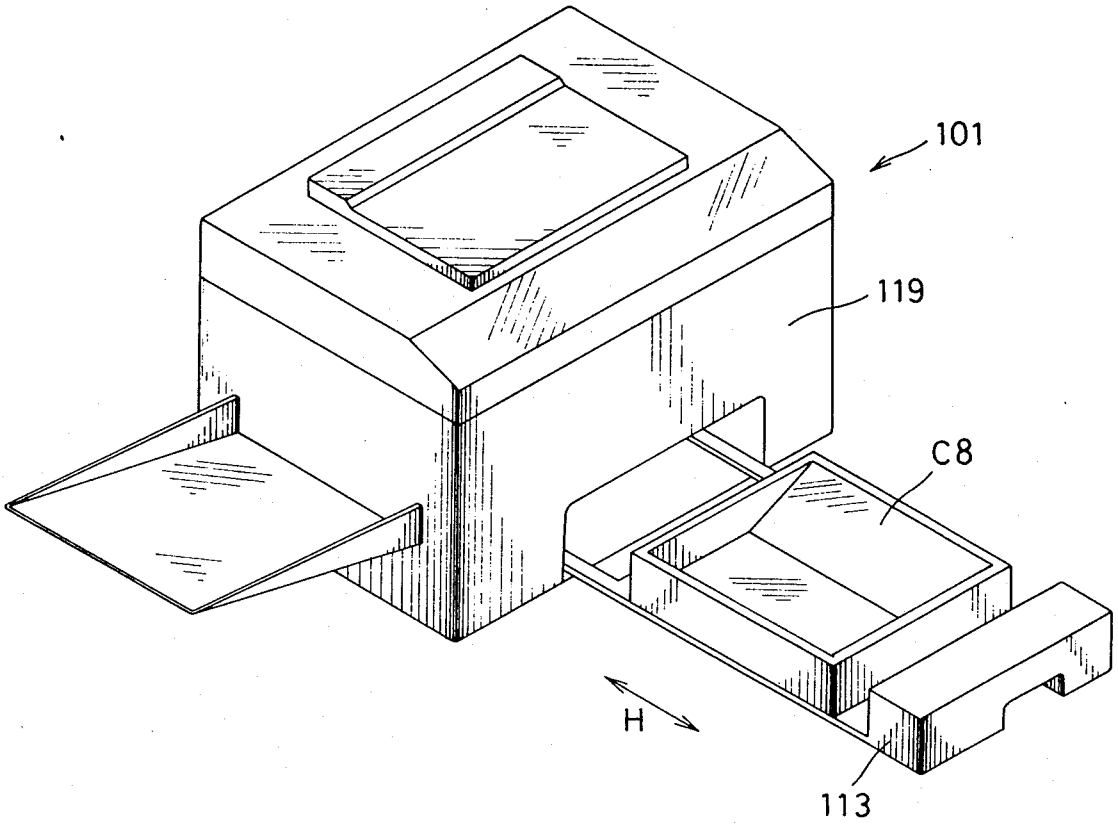
FIG. 10 is a perspective view of the electrophotographic copying apparatus incorporating another preferred embodiment of the paper-feeding device according to the invention.

It should be noted that the paper-feeding device 105 reflecting the above preferred embodiment is effectively applicable not only to the front pull-out type image processing apparatus shown in FIG. 10, but also to an copying machine which allows the extraction of the paper-feeding cassette from the side and front surfaces in both ways shown in FIG. 1. The paper-feeding device 105 of the above preferred embodiment is also applicable to other image processing apparatuses like an electrostatic printer incorporating the paper-feeding device which feeds the copying paper in the direction 90 degrees apart from the cassette-extraction direction by applying a paper-feeding roller for example.

While some of the preferred embodiments of the paper-feeding device according to the present invention have thus been described in reference to the accompanying drawings, it should be understood, however, that the invention is not limited to those preferred embodiments described above, but a wide variety of changes and modifications may also be implemented unless those variations depart from the spirit and scope of the invention.

As is apparent from the foregoing description, the paper-feeding device according to the present invention securely prevents the paper-feeding device from carelessly being drawn out of the image processing apparatus by the operator while the paper-feeding operation is underway after activating the image forming start switch, thus effectively saving copying papers while forming an image on it. The paper-feeding device according to the invention also prevents the copying paper from jamming. In particular, if the copying paper jams while forming an image on it, by securely inhibiting the extraction of the paper-feeding cassette from the image processing apparatus, the paper-feeding device according to the invention securely prevents the torn-up jammed paper from remaining at the midpoint of the paper-feeding path.

What is claimed is:

1. A paper-feeding device for feeding paper in a paper-conveying direction to an image processing apparatus, said device comprising:

a paper-feeding cassette means including a paper-feeding cassette and a paper-feeding cassette mount, said cassette being adapted for loading into the image processing apparatus and removable from the image processing apparatus in a direction substantially perpendicular to said paper-conveying direction.

locking means for engaging said paper-feeding cassette means to prevent said paper feeding cassette from being removed from the image processing apparatus; and locking control means for controlling said locking means to engage said paper-feeding cassette means during a paper-feeding operation and during a paper jam in a paper-feeding path, said locking-control means comprising means for determining a condition when a copying paper fails to pass through a predetermined position during a specific period of time from a start-up of copying paper delivery from said paper-feeding cassette, said locking control means causing said locking means to engage said paper-feeding cassette means in response to determination of said condition by said determining means.

2. A paper-feeding device according to claim 1, wherein said locking means comprises a stopper and an engaging member secured to said paper-feeding cassette means for engagement with said stopper.

3. A paper-feeding device according to claim 1, wherein said locking control means causes said locking means to disengage from said paper-feed cassette means when a cover of the image processing apparatus is opened or closed.

4. A paper-feeding device according to claim 1, wherein said paper-feeding cassette is substantially an insertion tray of a duplex image processing apparatus.

5. A paper-feeding device according to claim 1, wherein said cassette means is insertable into a predetermined position inside of the image processing apparatus and a detectable member is provided on a tip surface of said paper-feeding cassette means, said detectable member being detectable by a detecting device of the image processing apparatus when said cassette means is fully inserted into said predetermined position.

6. A paper-feeding device according to claim 1, wherein said cassette means is insertable into a predetermined position inside of the image processing apparatus and a detecting device for detecting a detectable member of the image processing apparatus is provided on a tip surface of said paper-feeding cassette means, said member being detectable by said detecting device when said cassette means is fully inserted into said predetermined position.

* * * * *